US005226553A

United States Patent [19]

Fiore

[11] Patent Number: 5,226,553

[45] Date of Patent: Jul. 13, 1993

[54] TACKLE BOX WITH LID-LATCHING HANDLE AND REMOVABLE CARRYING CASE

[75] Inventor: Joseph F. Fiore, Lebanon, Pa.

[73] Assignee: Woodstream Corporation, Lititz, Pa.

[21] Appl. No.: 901,151

[22] Filed: Jun. 19, 1992

Related U.S. Application Data

[60] Division of Ser. No. 852,533, Mar. 17, 1992, which is a continuation-in-part of Ser. No. 764,507, Sep. 20, 1991, and a continuation-in-part of Ser. No. 764,508, Sep. 20, 1991.

[51] Int. Cl.[5] ..... B65D 45/02

[52] U.S. Cl. ..... 220/318; 220/763; 220/764; 220/765; 206/315.11

[58] Field of Search ..... 220/318, 764, 763, 762, 220/756, 765, 752; 206/315.11, 372

[56] References Cited

U.S. PATENT DOCUMENTS

| | | | |
|---|---|---|---|
| 144,698 | 11/1873 | Plympton . | |
| 218,304 | 8/1979 | Morgan et al. . | |
| 1,026,093 | 5/1912 | Johnson . | |
| 1,137,078 | 4/1915 | Nicodemus et al. | 220/318 |
| 1,171,833 | 2/1916 | Boyle . | |
| 1,304,448 | 5/1919 | Browning . | |
| 1,472,707 | 10/1923 | Weisz | 220/763 |
| 1,722,004 | 10/1920 | Drumm . | |
| 1,905,955 | 4/1933 | Waehner | 220/763 |
| 2,047,176 | 7/1936 | Cisco . | |
| 2,233,789 | 3/1941 | Lichtenberger | 220/756 |
| 2,501,572 | 3/1950 | Marquez | 220/763 |
| 2,636,639 | 4/1953 | Frey | 220/318 |
| 2,873,880 | 2/1959 | Poulos | 220/756 |
| 3,144,160 | 8/1964 | Johnson . | |
| 3,185,338 | 5/1965 | Henning . | |
| 3,889,732 | 6/1975 | Wilkins . | |
| 3,960,289 | 6/1976 | Panicci | 220/318 |
| 4,118,018 | 10/1978 | Gruner et al. . | |
| 4,157,763 | 6/1979 | Betlejewski et al. . | |
| 4,179,039 | 12/1979 | Kawolics . | |
| 4,351,448 | 9/1982 | Ingersoll et al. | 220/318 |
| 4,592,482 | 6/1986 | Seager . | |
| 4,667,484 | 5/1987 | Tarozzi et al. | 62/371 |
| 4,691,840 | 9/1987 | Ferbrache . | |
| 4,819,827 | 4/1989 | DiSesa . | |
| 4,941,403 | 7/1990 | Cimenti . | |
| 4,982,863 | 1/1991 | Skillius . | |
| 5,044,513 | 9/1991 | Van Berne | 220/318 |

*Primary Examiner*—Allan N. Shoap
*Assistant Examiner*—S. Castellano
*Attorney, Agent, or Firm*—Jacobson, Price, Holman & Stern

[57] ABSTRACT

A tackle box has a box body with a hinged lid. The box body has a deeper front portion and a shallower back portion. Correspondingly, the lid has a deeper back portion and shallower front portion. The back portion of the box body carries a stack of interconnected slidably mounted superimposed trays which can be pulled out rearwardly cantilever fashion when the lid is opened. The front portion of the box body has superimposed pull-out drawers. The box has a bail-type pivoting handle with a lid-latching mechanism which only allows the lid to open when the handle is swung forwardly from a box-carrying position. In the top of the lid, there is a removable shallow carrying case which can be used separately from the box.

5 Claims, 7 Drawing Sheets

"A"
"B"
"C"
10
12
14
16
16a
16b
18
20
22
24
26
28
29
30
32
34
36
38
40
42
44
46

100
102
104
106
106a
106c
108
110
120
122
124
125
126
127
128
129
130
132
133
134
137
D
E
F
10

100
102
104
106b
120
124
125
126
127
129
132
133
134
135
136
137
138
140
142
144
146
14

TACKLE BOX WITH LID-LATCHING HANDLE AND REMOVABLE CARRYING CASE

CROSS REFERENCE TO RELATED APPLICATIONS

This is a divisional of application Ser. No. 07/852,533 filed Mar. 17, 1992, which in turn is a continuation-in-part of application Ser. No. 07/764,507 and 07/764,508, both filed Sep. 20, 1991.

BACKGROUND OF THE INVENTION

This invention relates to portable containers, principally tackle boxes, but applicable also to other types of containers such as tool boxes, coolers and the like. Accordingly, while the following disclosure is directed to a tackle box in particular, this is by way of example only, and the invention is not limited thereby.

The prior art is replete with different design tackle boxes. Primary concerns in the design of such boxes are, for example, optimum usage of the available box volume consistent with strength and lightness of weight along with accessibility and effective compartmentalization for the stored items. Two of the most common types of tackle boxes are the stacked-drawer type box and the pull-out tray type box. In the former type, a significant portion of, or indeed substantially the entire box volume may be accounted for by a plurality of discrete superimposed drawers which can be opened individually from the front of the box. In the latter type, a plurality of superimposed trays are connected together by pivotal links and are lifted out of the box into a staggered cantilever-like position, commonly by means of a hinged box lid connected to the trays, access being available to each tray in the open position.

The present invention provides a tackle box having one or more of the following features namely, a novel form of pull-out tray structure; a lid-latching handle arrangement; and a removable carrying case for frequently used items.

SUMMARY OF THE INVENTION

A tackle box as herein disclosed has a main box body and a hinged lid with a swinging yoke or bail type handle hinged to opposite side walls of the box body so as to extend over the lid. The handle has a substantially vertical carrying position in which lugs on the handle arms engage over corresponding projections on opposite sides of the lid, effectively to latch or lock the lid in place. From the carrying position, the handle can be swung toward the back of the box into a transport position in which the handle lugs move along tracks and engage respective stops on the lid. Again, in this position of the handle, the engagement of the stops and lugs effectively prevents the lid from opening. To open the lid, the handle must be swung forwardly from the carrying position disengaging the lugs from the projections.

Further, in a recess on top of the lid there is provided a removable shallow carrying case with its own hinged lid. The case, which is suitable for carrying frequently-used items when it is not necessary to carry the entire box, may fit into the recess by a bayonet-type fitting allowing the case to be placed in the recess from above and slid towards the back of the box to engage the bayonet fitting and hold the case in the recess. Similarly, to disengage the case, it is slid toward the front of the box, releasing the bayonet fitting and the case is then lifted from the recess. Alternatively, the case may slide into the recess from the front of the lid, the case having detents along its side edges which frictionally engage under and then behind flanges on the lid to releasably retain the case in position.

Additionally, sitting atop the box body in the back section of the box is a stack of trays mutually interconnected by slides allowing the trays to be pulled out into an extended cantilever-like configuration when the lid is opened providing access to the individual trays and preferably also to the interior of the box body below the trays. The slides may be angled so as to separate the trays vertically when they are extended improving access to the trays.

Additional features and advantages of the invention will become apparent from the ensuring description and claims read in conjunction with the attached drawings.

DESCRIPTION OF PREFERRED EMBODIMENTS

Referring firstly to FIGS. 1 to 8, illustrated tackle box 10 is made predominantly from molded plastic components in a manner generally well known in the art and comprises a main box body 12, a hinged lid 14 and a swinging bail-type handle 16 with arms, as **16*a* attached to pivots, as 18, on opposite side walls of the box body, and a web 16*b*** connecting the arms.

Figures 1, 2:
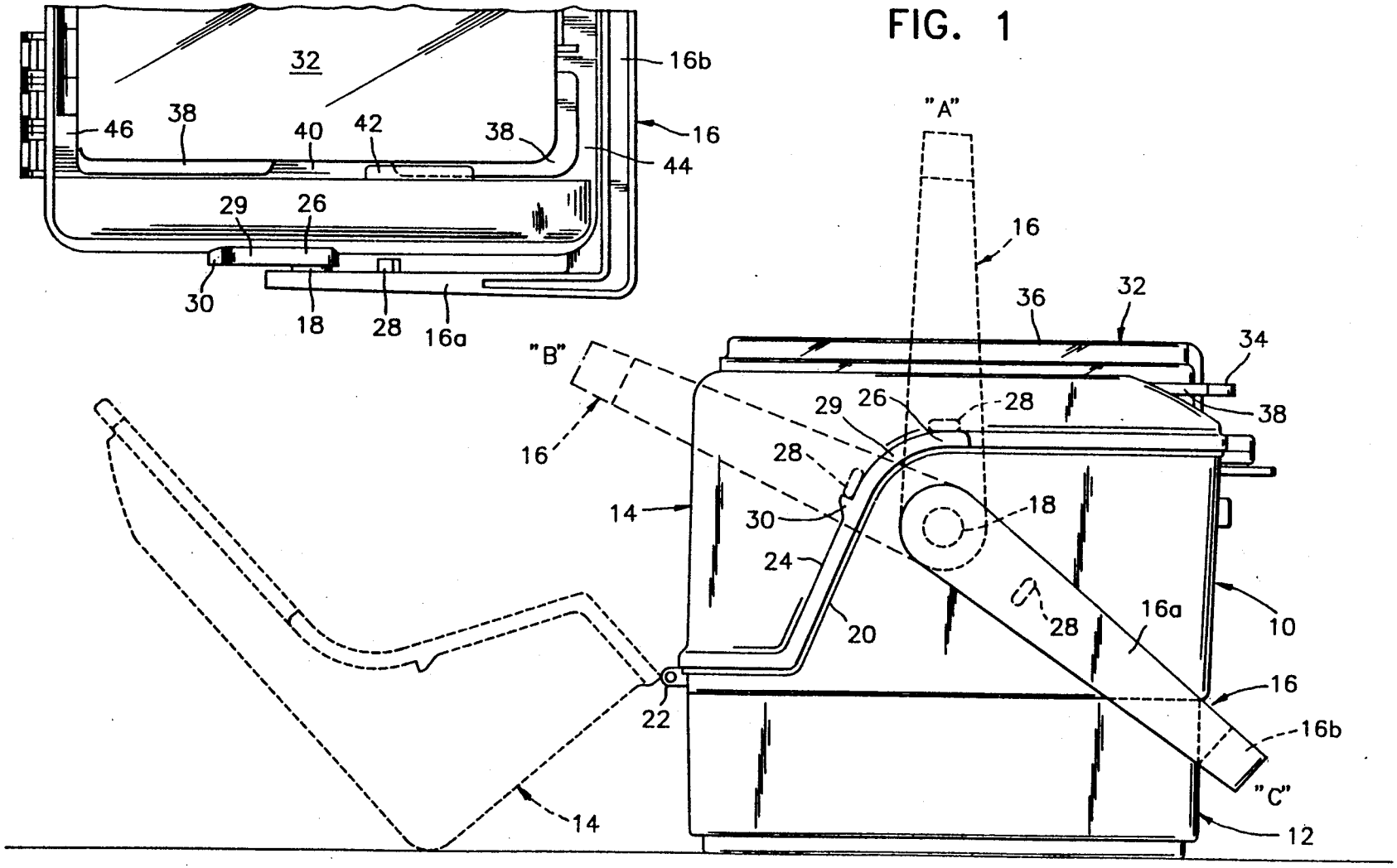
FIG. 1 is a side elevational view of a tackle box according to the invention.
FIG. 2 is a part plan view of the tackle box.
Figure 4:
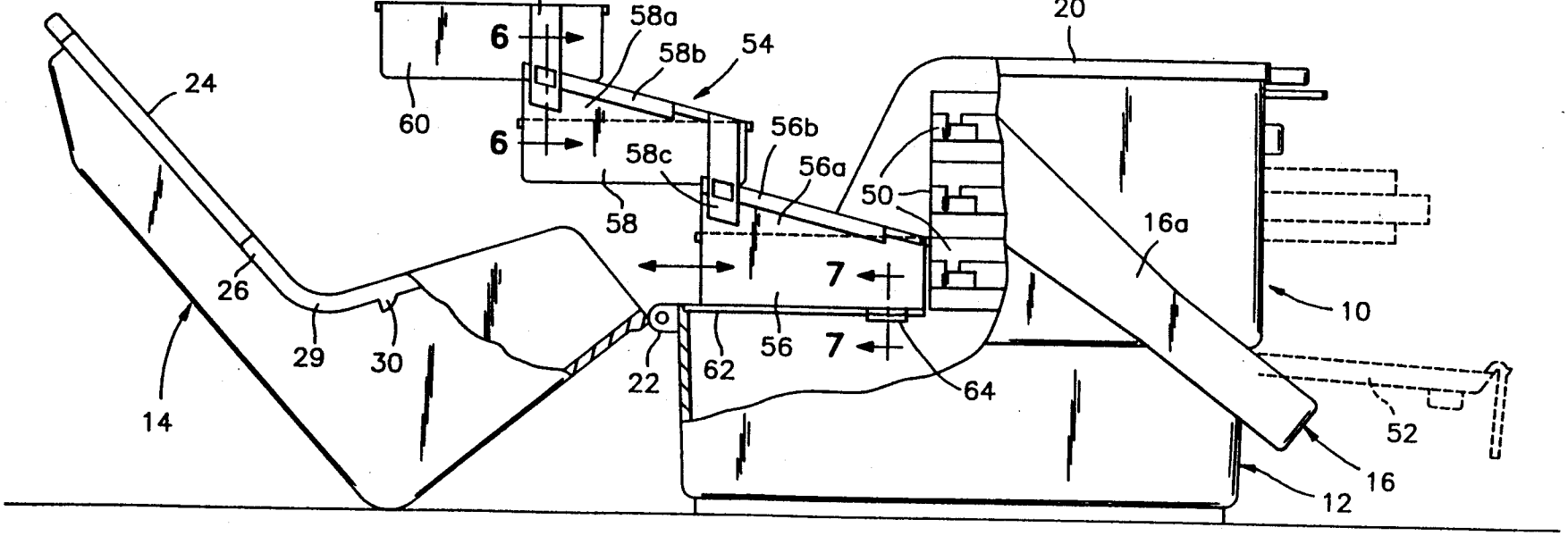
FIG. 4 is a side elevational view, part broken away and with the lid open.
Figure 8:
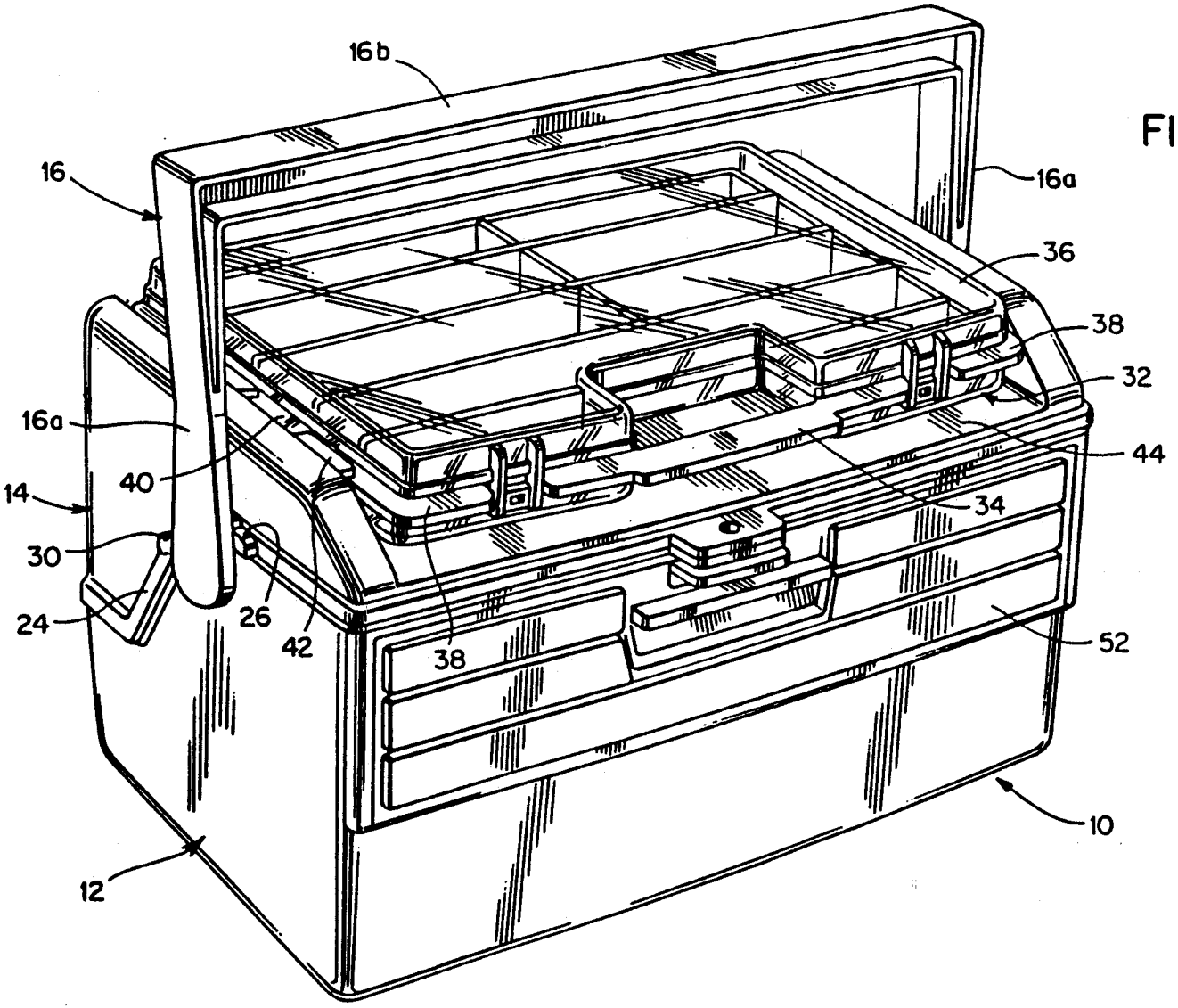
FIG. 8 is an overall perspective view of the tackle box.
Figures 9, 10, 11, 12:
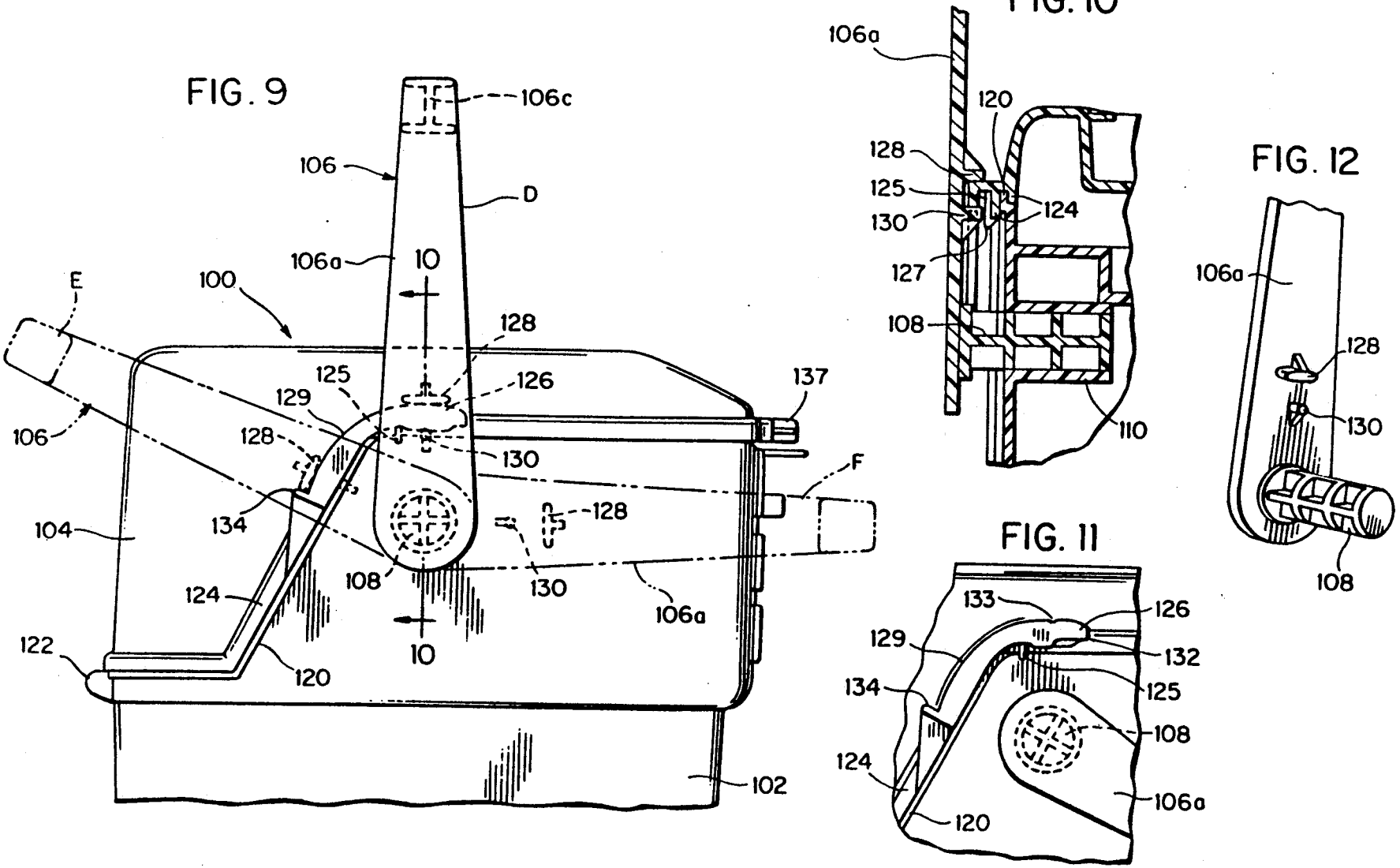
FIG. 9 is a side elevational view of a modified tackle box structure according to the invention.
FIG. 10 is a sectional view on line 10—10 of FIG. 9.
FIG. 11 is an enlarged side elevational view of a part of the modified box with the handle in a forward position.
FIG. 12 is a perspective view of a part of the handle of the modified box.
Figures 13, 14, 15:
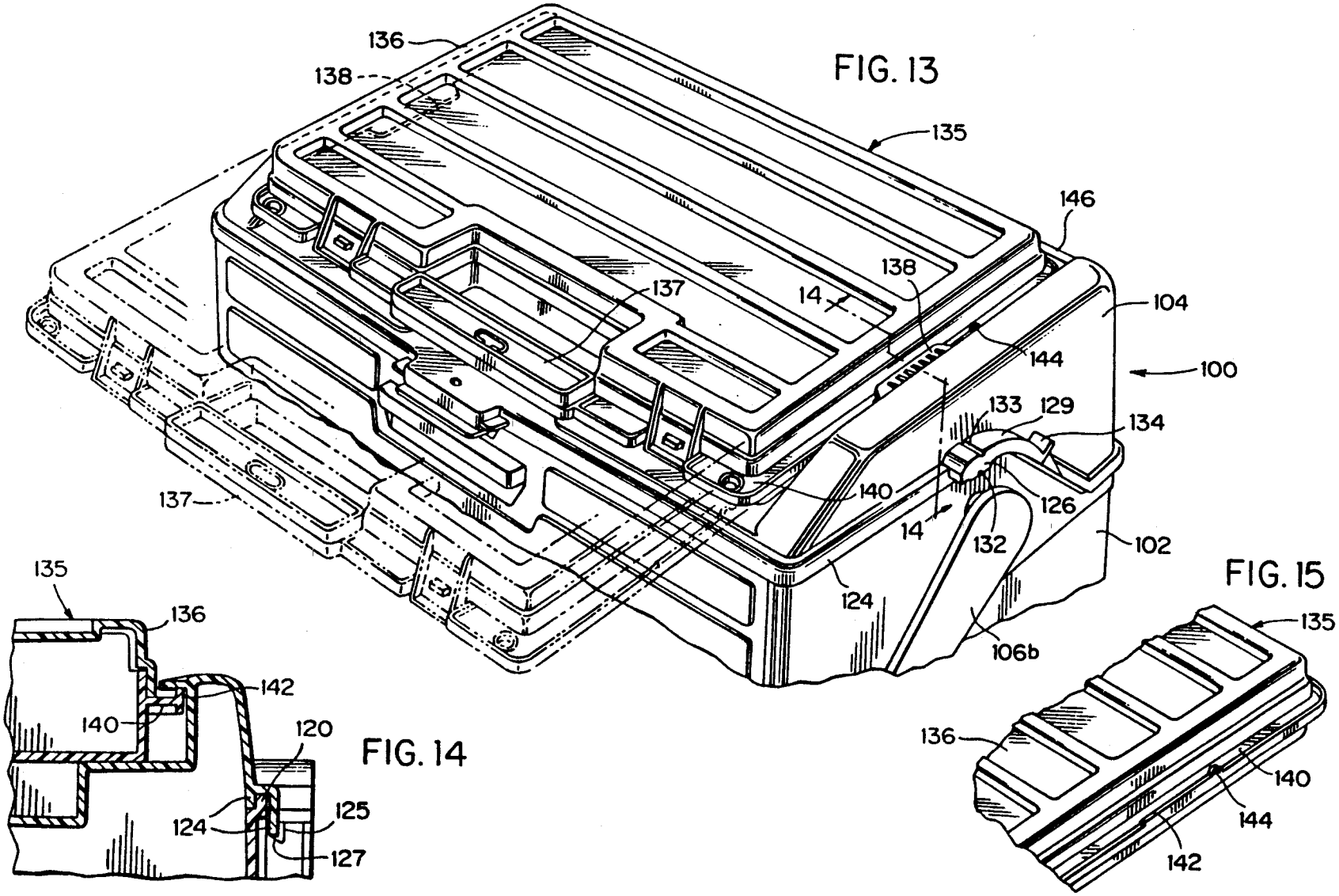
FIG. 13 is a perspective view from the front of the top portion of the modified box.
FIG. 14 is a sectional view on line 14—14 of FIG. 13.
FIG. 15 is a perspective view of part of a pull out carrying case for the modified box.

As seen most clearly in FIGS. 1 and 4, the side walls of the box body have an S-shaped upper rim or flange 20 which extends downwardly from the front of the box to adjacent the lid hinge 22 at the back of the box. The side walls of the lid have an interfitting lower peripheral rim or flange 24. Incorporated in rim 24 (on each side of the box) at a location corresponding with a vertical carrying position A (FIG. 1) of the handle, is a projection 26 over which a lug 28 on the inside of handle arm **16*a* fits with a friction fit, so as to effectively prevent the lid from opening (i.e., form a lid latch) in the carrying position of the handle and retain the handle in the upright position. Also, the lid rim 24 (on each side of the box) has a track 29 for lug 28 extending behind projection 26 and in the arc of movement of lug 28 towards the back of the box. The track terminates in a stop 30 for the handle. Thus, when the handle is moved back from the carrying position A along track 29, the lug and track interfere to prevent the lid from opening. The handle is then brought into a storage position B (where web 16*b* preferably is at or below the level of the lid) wherein the lugs 28 engage the stops 30 and prevent further backward movement of the handle. In this position of the handle, the lugs 28 are still in an interfering position with rim 24, preventing the lid from swinging open about hinge 22** and effectively maintaining the lid latching function of the handle.

In order to open the lid, it is necessary to swing the handle forwardly from the carrying position, for example to a position C in which the lugs 28 move off projections 26 and effectively clear of rim 24 to free the lid for swinging movement about the hinge.

The top of the lid 14 is recessed substantially over its entire area (although a smaller recessed area could be provided) to receive a shallow removable carrying case 32 having a fixed handle 34 and its own hinged lid 36. The carrying case fits into the lid 14 by means of a bayonet-type retention fitting comprising shallow flanges 38 around the rim of the carrying case with a gap 40 on each side (only one side is shown in the drawings) and a projecting flange 42 on each sidewall of the lid recess 44. The flanges 42 are of a length to fit in the gaps 40 and the flanges 42 are located forwardly of center relative to the front and back of lid 14. Thus, to attach the carrying case to the lid 14, the case can be placed into recess 44 from above so long as the flanges 42 are aligned with the gaps 40. With the case thus placed in the recess, the flanges 42 are located above the level of flanges 38. Accordingly, the case can be pushed back against a back wall 46 of the recess causing the front flanges 38 to move under flanges 42, with an interference fit thereby retaining the case 32 in the recess. To improve the retention of the case, suitable detent projections can be provided on the case and/or on the walls of the recess. To remove the case, it is slid forward until flanges 42 align with the gaps 40 and allow the case to be lifted from out of the lid. The case can be suitably compartmented and is suitable for carrying relatively small items when the entire tackle box is not needed.

Internally, the box body 12 has a front section 48 with a plurality of superimposed conventional-type pull-out drawers 50 and a fold-down hinged cover 52 for the drawers at the front of the box. The drawer and cover structure being conventional, no further disclosure is required herein.

The back section of the box body is provided with a stack 54 of sliding cantilever-type trays 56, 58, 60 according to a further feature of the invention. In this regard, the lowermost tray 56 is slidably mounted along horizontal flanges or runners 62 on the inner walls of the box body by way of slide elements 64, so that when the lid 14 is opened, (FIG. 4) the tray 56 can be moved inwardly and outwardly relative to the box body along the runners 62 as indicated by the two-way arrow.

The sidewalls of each of the trays 56 and 58 have upwardly and outwardly inclined extensions **56*a* and 58*a* with respective inclined guides 56*b*, 58*b* along the tope edges of the extensions. Tray 58 has downwardly extending sliders 58*c* which grip the guides 56*b* of tray 56 so that tray 58 can slide upwardly and outwardly with respect to tray 56 into the cantilevered open position shown in FIG. 4. A suitable stop, not shown, may be provided to prevent the tray 58 from being pulled off tray 56. By making the guide 56*b* upwardly inclined, vertical separation of the trays 56 and 58 is provided when the trays are opened to improve access to tray 56**. Similarly, however, the trays could have horizontal guides if vertical separation between the trays is not required.

Topmost tray 60, which is absent the sidewall extensions, has downwardly projecting sliders **60*c* which grip the guides 58*b* of tray 58 so as to allow sliding of tray 60 to the open cantilevered position in like manner to tray 58. Again, a suitable stop, not shown, may be provided to prevent pulling off of tray 6**.

Figure 5:
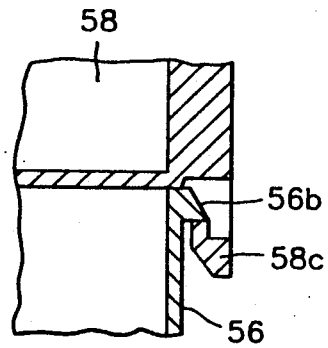
FIG. 5 is a sectional view on line 5—5 of FIG. 3.
Figure 6:
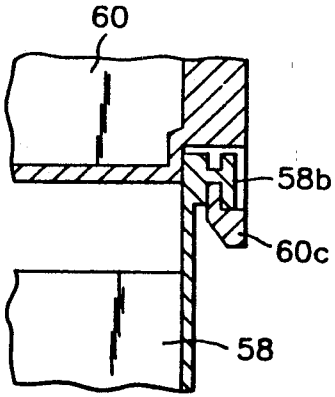
FIG. 6 is a sectional view on line 6—6 of FIG. 4.
Figure 7:
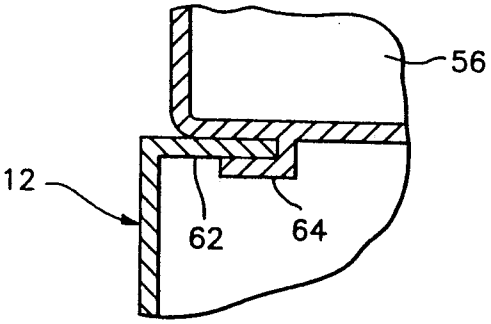
FIG. 7 is a sectional view on line 7—7 of FIG. 4.

As shown in FIG. 6, the main length of guide **58*b* (guide 56*b* is similar) has a channel shaped cross-section with slider 60*c* fitting in the channel. As shown in FIG. 5, however, the forward end section of guide 58*b* is substantially trapezoidal shaped and guide 56*b* being of similar configuration at its forward end. This arrangement allows the trays to be separated, and snapped together when in the closed nested position due to a degree of resilience in the slides 58*c* and 50*c***.

Figure 3:
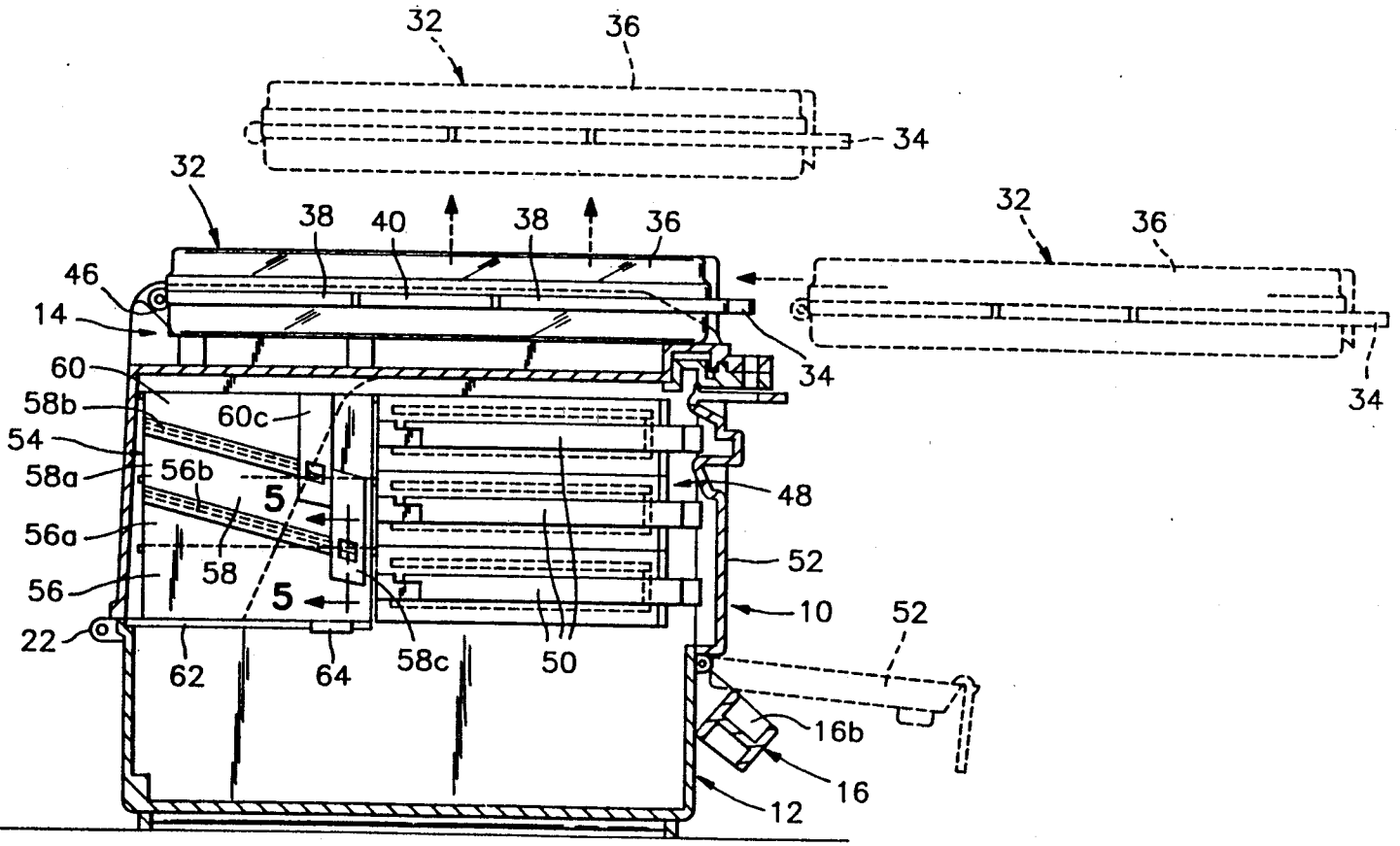
FIG. 3 is a sectional elevation.

It is evident from the above that the tray stack 54 can be extended from the nested configuration shown in FIG. 3 to the extended cantilevered configuration shown in FIG. 4 by outward sliding of the trays 60 and 58. Also, tray 56 can slide in and out on runners 52 to provide access to the lower portion of the box body.

The modified tackle box 100 shown in FIGS. 9–16 is again made predominantly from molded plastic components in a similar manner to box 10 and comprises a main box body 102, a hinged lid 104 and a swinging bail-type handle 106 with arms **106*a*, 106*b* attached to the box body by cylindrical pivots 108 which press fit into cylindrical socket bearings 110 on opposite side walls of the box body. The handle has a web 106*c*** connecting the arms.

The side walls of the box body again each have a substantially S-shaped upper rim or flange 120 which extends downwardly from the front of the box to adjacent the lid hinge 122 at the back of the box. The side walls of the lid each have an interfitting channel-shaped lower peripheral rim or flange 124. To guide the walls of the channel-shaped lid rim 124 into the rim 120 of the box body when the lid is being closed, each side wall of the lid has a projecting guide member 125 with a ramp surface 127 that engages the outside of rim 120 to guide the lid into place. Incorporated in rim 24 (on each side of the box) at a location corresponding with a vertical carrying position D (FIG. 9) of the handle, is a projection 126 over which a lug 128 on the inside of the respective handle arm **116*a* or 116*b* fits with a friction fit, so as to effectively prevent the lid from opening (i.e., form a lid latch) in the carrying position of the handle. In this case, however, the projection 126 is somewhat thicker than projection 26 of the previous embodiment and the handle arms 116*a*, 116*b* each have a further circular lug 130 which frictionaly engages under the respective projection and snaps into a recess 132 in projection 126 to form a retaining means for locating the handle in the carrying position. In this arrangement the lugs engage the projection 126 with a relatively tight friction fit and some force is needed to move the handle into and out of the carrying position. The upper lugs 128 may have a shallow V-shaped profile which defines a projecting formation and provides a similar snap-in retaining action with recesses 133 in the top surfaces of projections 126. Again, the lid rim 124 (on each side of the box) has a track 129 extending behind projection 126 in the arc of movement of lugs 128 and 130 towards the back of the box. The track terminates in a stop 134 for the handle. Thus, again, when the handle is moved back from the carrying position D along track 129, the lugs and track interfere to prevent the lid from opening. The handle is then brought into a storage position E wherein the lugs engage the stops 134, prevent further backward movement of the handle, and again are in an interfering position with rim 124**, preventing the lid from swinging open.

As previously, to open the lid, it is necessary to swing the handle forwardly from the carrying position, to a position F in which the lugs move off projections 126 and effectively clear of rim 124 to free the lid for swinging movement about the hinge.

The top of the lid 114 is again recessed substantially over its entire area to receive a shallow removable carrying case 135 having a fixed handle 137 and its own hinged lid 136. In this embodiment rather than the previously described bayonet fitting, the carrying case slides into the recess from the front of the lid under flanges 138 which project inwardly from respective side walls of the recess. The carrying case body has a projecting rim 140 on each side with an upwardly formed elongate ridge 142 having a projection 144 at the back end (see FIG. 15). when the case 134 is slid into the lid 114 from the front, the rim 140 clears the flanges 138, but the projections 144 and ridges 142 are dimensioned to frictionally engage the flanges and provide resistance to sliding of the case. In the fitted position of the case, its rear wall engages rear wall 146 of the lid and the ridges 142 remain under the flanges 138 to resist forward sliding of the case. The projections 144 are located behind the flanges. To remove the case, it must be pulled forwardly against the resistance provided between the flanges 138 and ridges 142, and then against the increased resistance between the flanges 138 and the projections 144.

Figure 16:
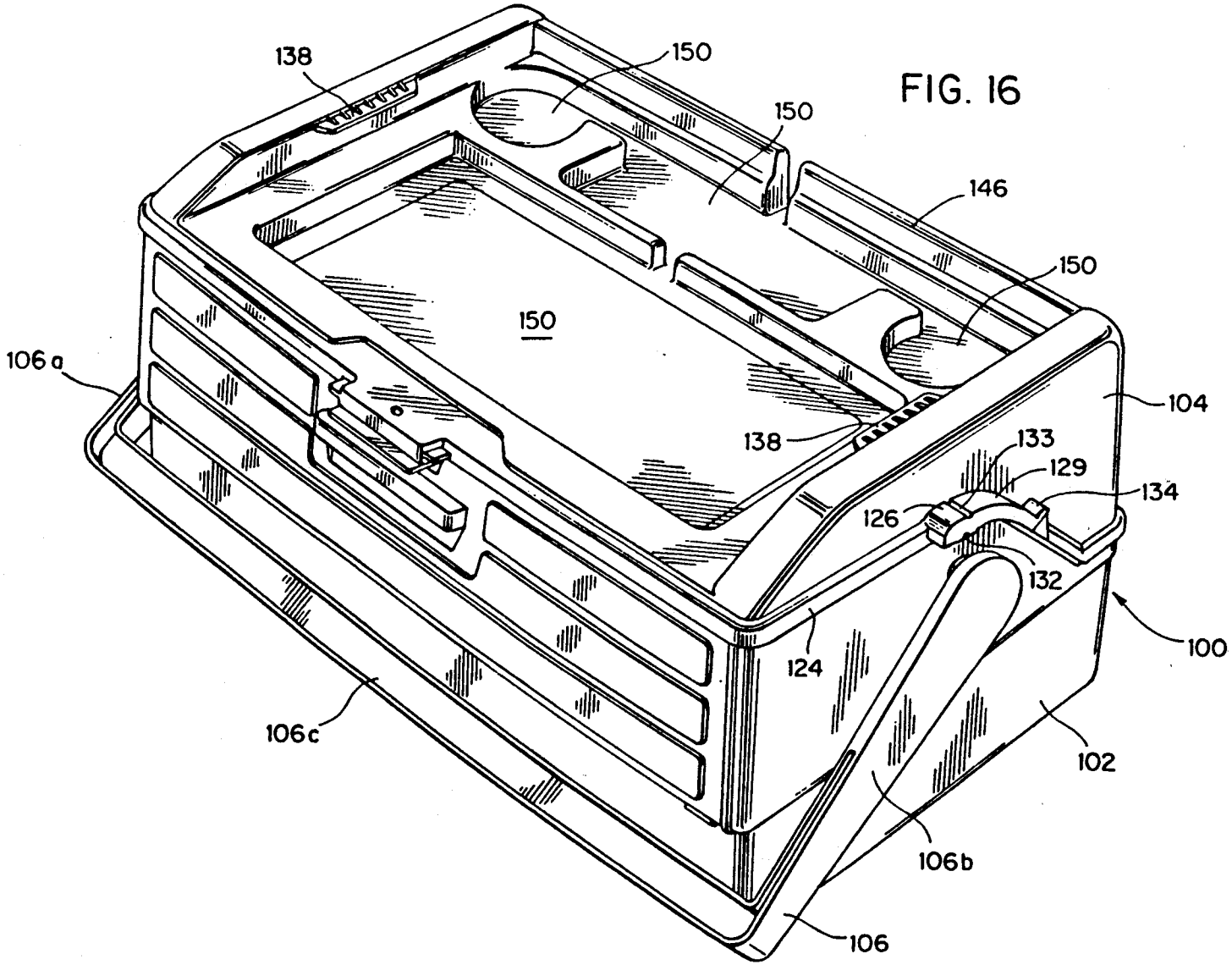
FIG. 16 is a perspective view of the modified box with the pull out carrying case removed.

As shown in FIG. 16 the base of the lid recess may be molded to form compartments 150 which can be used to store small items when the case is in place or which can be shaped to receive specific items such as drinking glasses, food storage containers and the like when the carrying case is removed.

Internally the tackle box 100 may be provided with drawer and tray structures similar to those described in connection with box 10.

What is claimed is:

1. A portable box structure comprising a box body with a lid, a bail-type handle having arms pivotally connected to opposite side walls of the body, projecting means on opposite side walls of the lid and corresponding lugs on said arms of the handle for sliding onto and engaging over said projecting means to prevent the lid from opening when the handle is in an upright box-carrying position and for sliding off said projecting means when the handle is moved to a box-opening position, the box further including male and female retaining means on the handle and on said projecting means respectively, the retaining means being positioned for snap fitting interengagement when the handle is moved into said box-carrying position to locate the handle in the box carrying position and for disengagement as the handle is moved from said box-carrying position.

2. The structure as defined in claim 1 wherein the retaining means on the handle comprises a projecting formation on said lug and the retaining means on said projecting means comprises a recess on an upper surface of the projecting means for receiving said projecting formation when the handle is in the box-carrying position.

3. The structure as defined in claim 1 wherein the retaining means on the handle comprises a further lug on the handle for frictionally engaging an undersurface of said projecting means and the retaining means on the projecting means comprises a recess in said undersurface for receiving the further lug when the handle is in the box-carrying position.

4. The structure as defined in claim 1 wherein the lid has a hinge connection with a back wall of the box body and wherein the side walls of the lid have respective tracks extending rearwardly from the respective projecting means towards the hinge connection for interfering with said lugs and preventing the lid from opening when the handle is moved towards the hinge connection.

5. The structure as defined in claim 4 wherein each track terminates in a handle stop for arresting the handle in a handle storage position.

* * * * *